US009205477B1

(12) United States Patent
Neubauer

(10) Patent No.: US 9,205,477 B1
(45) **Date of Patent: *Dec. 8, 2015**

(54) METHOD AND DEVICE FOR STRAIGHTENING WHEEL

(71) Applicant: Donald Neubauer, Harrison Township, MI (US)

(72) Inventor: Donald Neubauer, Harrison Township, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/252,757

(22) Filed: Apr. 14, 2014

Related U.S. Application Data

(63) Continuation of application No. 12/036,737, filed on Feb. 25, 2008, now Pat. No. 8,695,395, which is a continuation-in-part of application No. 11/368,048, filed on Mar. 3, 2006, now Pat. No. 7,334,449.

(60) Provisional application No. 60/658,215, filed on Mar. 3, 2005.

(51) Int. Cl.
*B21D 3/16* (2006.01)
*B21D 1/08* (2006.01)

(52) U.S. Cl.
CPC ... *B21D 3/16* (2013.01); *B21D 1/08* (2013.01)

(58) Field of Classification Search
CPC ..... B21D 1/10; B21D 1/12; B21D 1/14; B21D 1/145; B21D 3/14; B21D 1/08; B21D 3/16
USPC ..... 72/316, 392, 393, 447, 457, 705
See application file for complete search history.

(56) References Cited

U.S. PATENT DOCUMENTS

| | | | | |
|---|---|---|---|---|
| 2,282,118 | A | 5/1942 | Daniel | |
| 5,303,573 | A * | 4/1994 | Douglas | 72/420 |
| 5,845,914 | A | 12/1998 | Lenkman | |
| 6,367,303 | B1 * | 4/2002 | Hizono | 72/316 |
| 2004/0035164 | A1 * | 2/2004 | Blaser, Jr. | 72/31.02 |

* cited by examiner

*Primary Examiner* — Debra Sullivan
(74) *Attorney, Agent, or Firm* — Young Basile Hanlon & MacFarlane P.C.

(57) ABSTRACT

A method and apparatus for straightening dents and irregularities in wheels including a spindle, a platen mounted on the spindle configured such that the wheel can be mounted on the spindle with the spindle projecting through the central hub hole and at least one actuator device positionable between the spindle and a section of the wheel to be straightened, the actuator exerting a straightening force on the rim of the wheel and a mobile device including the same.

19 Claims, 7 Drawing Sheets

METHOD AND DEVICE FOR STRAIGHTENING WHEEL

This application is a Continuation application and claims priority to U.S. patent application Ser. No. 12/036,737 filed Feb. 25, 2008 and is a Continuation-in-Part application and claims priority to U.S. patent application Ser. No. 11/368,048 filed Mar. 3, 2006, now issued as U.S. Pat. No. 7,334,449 which claims priority to U.S. provisional patent application 60/658,215, filed Mar. 3, 2005 the entity of all documents are which is incorporated by reference herein.

BACKGROUND

The present disclosure is directed to a wheel straightening machine. More particularly, the present invention is directed to a method and device for straightening a vehicle wheels but not limited to alloy wheels.

Various methods have been proposed for wheel straightening. These methods include various manually intensive methods as well as certain power-driven methods. Initially, methods for straightening alloy wheels typically occurred in shop environments where a wheel and tire assembly could be safely and efficiently removed and operated on.

More recently, methods have been proposed for performing on-site wheel straightening functions. These methods have been limited. It is difficult to work in an on-location environment as the area for doing on-location wheel straightening operations is typically limited to a confined area in the back of a truck or van. Additionally, various methods required tire removal and/or breaking the tire bead in order to mount the wheel on the straightening apparatus or perform straightening operations. Various proposals for providing wheel straightening operations with the tire intact have not provide methods for monitoring and controlling the pressure exerted on the wheel structure or providing variable pressure over a variety of angles.

It has also been proposed that the wheel straightening system be motorized to provide greater efficiency in related ancillary operations. However, to date no method has been provided that adequately accomplishes wheel straightening operations that can be used in a variety of locations such as a mobile environment.

Various dents and irregularities are of a nature that can require more dynamic method of repair and/or treatment than have been previously available in order to effectively and efficiently address the dents and irregularities and repair the wheel for additional service.

SUMMARY

Disclosed herein is a wheel straightening apparatus comprising a spindle having a first end and a second end, and a platen mounted on the spindle at a point between the first end and the second end. The platen is configured to maintain a wheel assembly in position coaxially relative to the spindle. The wheel assembly includes a rim having at least one central hub and a central body connected to and interposed between the hub and the rim. The device also includes at least one actuator positionable between the spindle and a section of the wheel rim to be straightened, the actuator configured to exert a straightening force on at least a localized area of the rim. Also disclosed is a device that includes at least the dynamically controllable actuators in which at least two actuators are positionable between the spindle and the wheel rim and at least one additional actuator is positionable between the wheel rim and a brace external to the spindle.

Also disclosed herein is a device and method for addressing and correcting at least one dent or other abnormality present in at least a localized area of a wheel rim employing a plurality of actuators configured to exert a plurality of forces acting on the localized region, the forces exerted either simultaneously or in a suitable sequence.

DESCRIPTION

Figure 1:
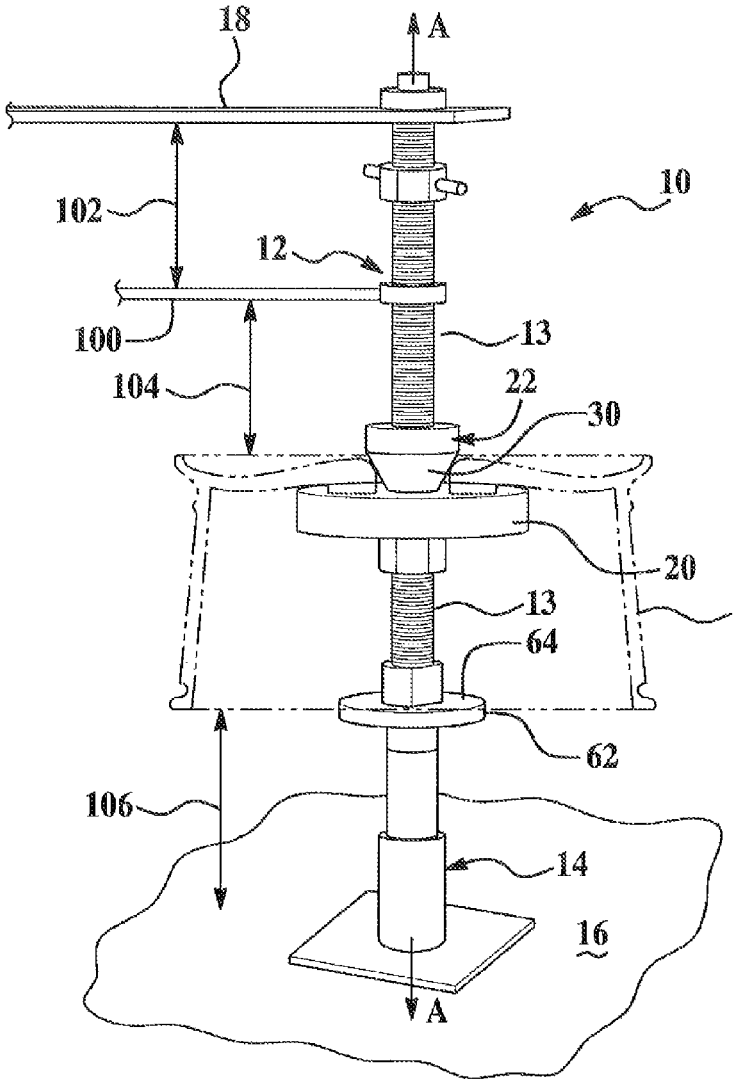
FIG. 1 is a perspective view of the wheel straightening device disclosed herein.
Figure 2:
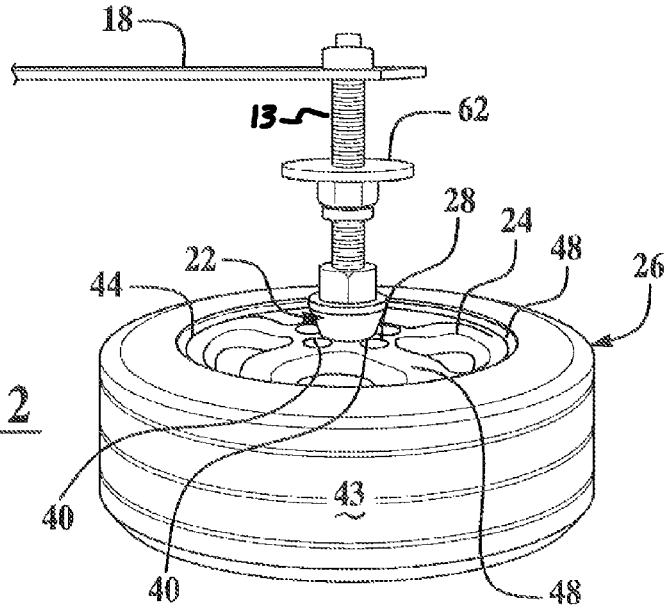
FIG. 2 is a detail of FIG. 1 with a wheel assembly mounted on the spindle and held in place by the positioning member.
Figure 3:
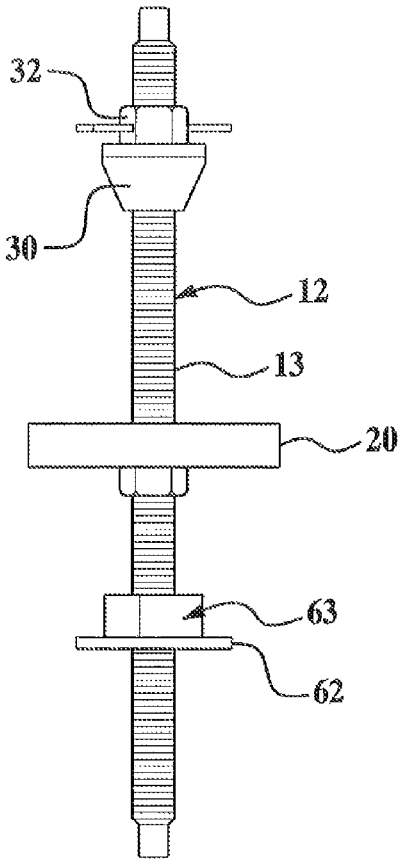
FIG. 3 is a side view of the wheel straightening mechanism showing the platen centrally positioned, the wheel positioning mechanism left, and a manual turning mechanism left.
Figure 4:
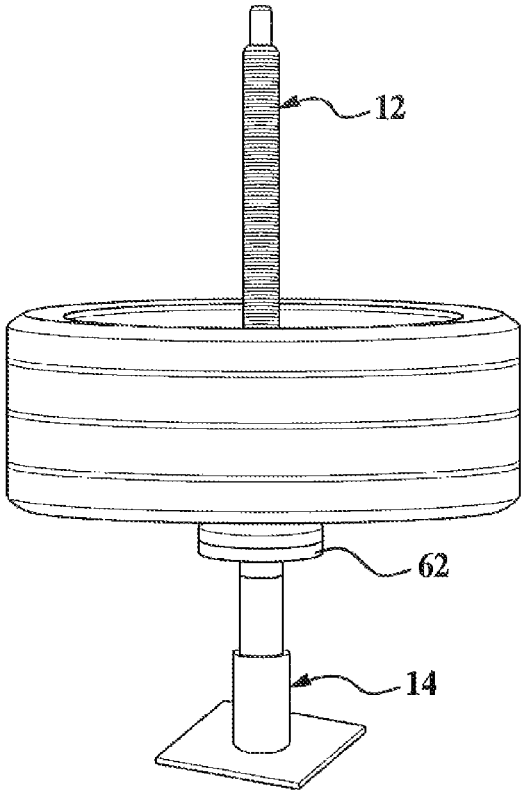
FIG. 4 is a detail of the wheel straightening mechanism mounted with the rear or nondress face in the upward position.

In its broadest form, the device 10 disclosed herein is composed of a spindle apparatus 12 releasably connected to mechanism 14 for perpendicular attachment to a lower support surface 16 such as a frame, floor, or bed of a suitable truck or other mobile device. The mechanism 14 may include suitable bearings and devices for facilitating rotational movement of the spindle apparatus 12 around an axis A extending longitudinally through the spindle. It is also contemplated that rotational movement can be facilitated by suitable devices connected to the spindle in either permanent or detachable manner. The spindle apparatus also has an opposed end adapted to be rotationally mounted on a suitable bracket device 18, if desired. While the bracket 18 is shown in FIGS. 1 and 2 as a bracket extending from a structure such as a sidewall of a suitable mobile device, it is contemplated that other suitable position limiting and stabilizing mechanisms can be employed, as desired or required.

Figure 9:
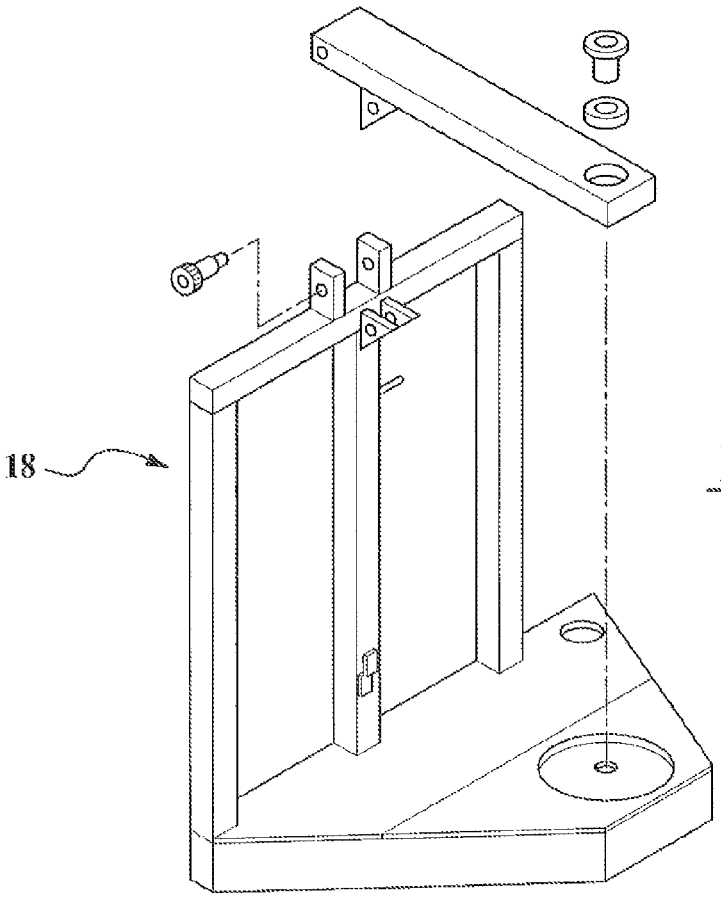
FIG. 9 is an exploded perspective view of an embodiment of a bracket member as disclosed herein.
Figure 10:
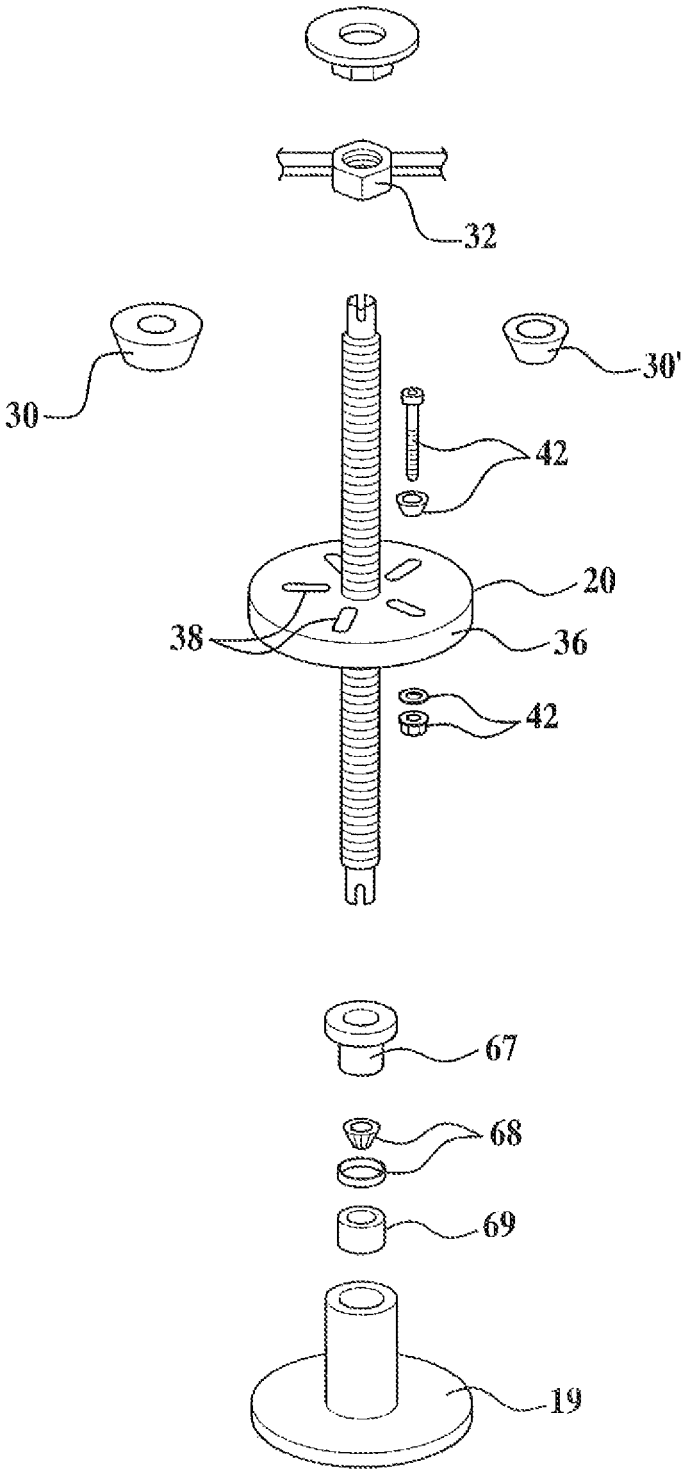
FIG. 10 is an exploded view of an embodiment of a spindle assembly as disclosed herein.

It is contemplated that the spindle apparatus 12 can be mounted in any suitable fashion to permit rotation during appropriate phases of the wheel assembly straightening operations. Therefore, it is contemplated that the bracket device 18 may be modified or eliminated in certain embodiments as desired or required. It is also contemplated that the bracket device 18 may be configured as a self-supporting structure such as that depicted in FIG. 9. It is contemplated that the spindle apparatus 12 can be configured to accommodate wheels of different diameters with wheel rim diameters up to or including 36 inches being contemplated.

In various additional embodiments, it is contemplated that the spindle apparatus 12 can be detached from connection with any suitable mounting device with suitable actuators in place and the fixtured spindle can stored moved or operated on as desired or required.

The spindle apparatus 12 has a platen 20 positioned at an appropriate location on the spindle generally proximate to the midpoint. The platen 20 will be described in further detail subsequently. Also present on the spindle apparatus 12 is a suitable positioning device 22, shown in the picture as a frustoconical member in FIGS. 2, 4, 5, 6, and 7. The positioning device 22 can be placed in clamped abutting engagement against the outer or dress face 24 of the wheel assembly 26 when the wheel assembly 26 is positioned in operable orientation on the spindle apparatus 12. The positioning member 30 can be held by a series of clamps as desired or required with the spindle apparatus 12 extending through the central hub shaft 28 of the wheel assembly 18. The positioning device 22 can be configured to engage the hub shaft 28 of various wheel assembly configurations in secure positioned manner. The positioning device 22 can include a suitable frustoconical member 30 as well as suitable securing devices such as clamp 32 to maintain the frustoconical member in contact with central hub shaft 18.

It is contemplated that the frustoconical member 30 can be employed to center the wheel assembly 26 on the spindle assembly 12 for measurement and analysis. It is contemplated that the device 10 may include additional or different positioning members.

Figure 6:
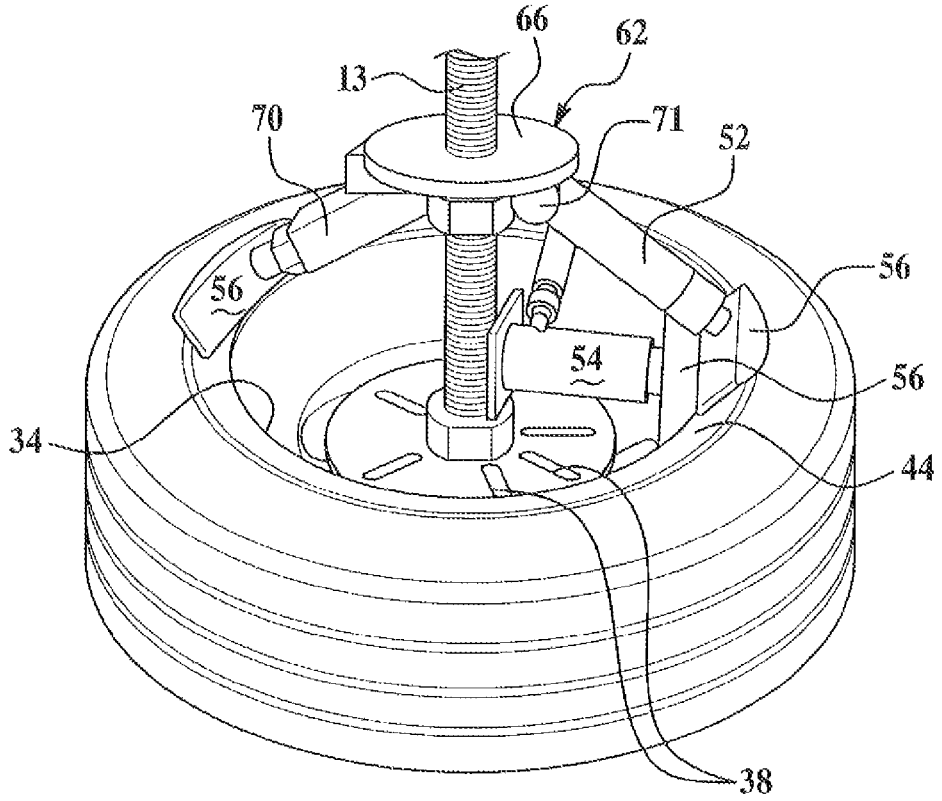
FIG. 6 is a detail of the wheel straightening apparatus with a plurality of actuators in an operative position on the reverse face of the wheel assembly unit.

The platen 20 is positioned on the spindle apparatus 12 at a suitable position proximate to its midpoint. It is contemplated that the platen 20 can be permanently or moveably attached to the spindle as desired or required. When the spindle apparatus 18 is in the use configuration, the platen 20 is positioned such that it is in abutting relationship with the inner or non dress face 34 of the wheel assembly. As best seen in FIG. 6, the platen is positioned against the central inner surface of the wheel assembly 26.

The wheel assembly 26 can be fastened to the platen 20 through lug nut holes 40 in the wheel assembly 26. In this manner, fastening can mimic or approximate the fastening conditions encountered when the wheel assembly is fastened to the hub on the vehicle. This assembly fastening configuration recreates mounting conditions. In this manner, the straightening operations can be accomplished under conditions that closely approximate use conditions; i.e., the conditions under which the bend originally occurred. In this configuration, it is contemplated that each fastener can be torqued separately to fasten the wheel to the platen 20 and associated spindle 13.

The platen 20 as depicted is a circular disc 36 that includes a series of slots 38 positioned therethrough. The slots 38 are adapted to permit fastening engagement between the wheel assembly and the platen 20. The slots 38 are positioned to correspond with one or more of the lug nut holes 40 of the wheel assembly 26. The device 10 can also include suitable fasteners 42 to position and anchor the wheel assembly 26 with respect to the device 10. The platen 20, affixed to the spindle apparatus provides a mounting surface to provide fixed engagement of the mounted wheel assembly 26 relative to the spindle apparatus 18. It is contemplated that all slots are positioned at 72° intervals with the exception of two slots that fall at 180° opposite one another. The positions of the slots are suitable to accommodate wheel assemblies with various numbers of lug nut holes, for example, but not limited to four hole, five hole, six hole, and eight hole configurations.

It is contemplated that the wheel straightening apparatus can be used on various wheel assemblies 26 used on various automotive vehicles. The wheel assemblies 18 can be composed of any suitable material of which alloy wheels are one configuration. Wheel assemblies can generally include elements such as rim 44, central hub 46, with shaft 28 defined therein, and central body portion 48.

It is contemplated that the assembly disclosed can be used to straighten wheel assemblies 26 with or without the tire 43 and tire bead intact. It is also contemplated that various dents and irregularities on the inner and/or outer surfaces 24, 34 can be addressed using the apparatus disclosed herein.

The device 10 also includes at least one actuator device 50 configured to be removably positioned between the spindle apparatus 12 and the rim 44 of the wheel assembly 26 when the actuator device 50 is in the use or operative position.

It is contemplated that the device 10 can include multiple actuator devices 50 as desired or required. The actuator devices 50 can be any suitable device or apparatus capable of exerting an outward force or pressure between spindle shaft 13 and a desired region of the rim 44. Actuator devices 50 may include but are not limited to pneumatic or hydraulic rams 52, 54 as well as manually operated jack screws 70. Where desired or required, it is contemplated that the device 10 can also include suitable frames on which actuator devices 50 can be braced. Suitable frame elements include, but are not limited to, beam 100 connected to the spindle 13 and extending outward therefrom. The beam 100 is positioned between the bracket 18 and the platen 20. It is contemplated that the beam 100 can be braced against bracket 18 by any suitable means such as bracing jackscrew 102. Where desired or required, the device can include one or more unites such as hydraulic run between the beam 100 and the wheel rim 44.

The units such as hydraulic or pneumatic rams 52, 54 may be configured with suitable heads 56 that address the desired region of rim 44. As depicted, the heads 56 can have any suitable configuration to address the localized bend or trauma in the wheel rim. As depicted, the head 56 has a suitably arcuate contact surface 58 configured to transfer suitable deformative pressure to the rim 44. Other geometries can be employed as desired or required. The head can be made of any suitable material. In one embodiment, a polymeric material such as nylon can be employed. Other suitable materials can be employed. Such materials are those that can transfer suitable bending force while protecting the integrity of the wheel surface, particularly from nicks and scratches.

The opposed end of the hydraulic ram 52, 54 or jackscrew 70 can be configured to make suitable contact with the spindle apparatus 12 either in direct contact with the spindle shaft 13 or in indirect contact as described subsequently.

As used herein, the term "deformative pressure" is the force necessary to address and correct a bend or irregularity in the rim 44 of the wheel assembly 26. It is contemplated that "deformative pressure" can be applied directly to the bend or irregularity or to any region proximate to or distant from the identified irregularity to correct or minimize the identified defect. Thus, the hydraulic or pneumatic rams 52, 54 can be those capable of delivering localized forces.

The localized force can be varied from ram to ram and/or jackscrew to jackscrew depending upon the nature of the bend, deformity, or trauma, and its location on the wheel rim 44. It is also contemplated that the localized force can be regulated so that it increases at a suitable rate and that the force increase can be discontinued at a point where correction of the bend, deformity or trauma is corrected. Thus, it is contemplated that the actuator device(s) can include suitable pressure regulators and/or feedback devices as desired or required to control the rate of pressure increase and/or discontinue pressure increase. This can include but need not be limited to suitable pressure gauges associated with one or more actuator devices.

It is contemplated that each actuator can be configured to operate independently of one another as desired or required. It is also contemplated that one or more actuators can operate in contact to pressurize or depressurize if required.

As depicted, it is contemplated that the actuator(s) will be rated to permit pressurization up to a maximum of 10,000 psi. It is understood that the pressure maximum may be adjusted downward as required by operating conditions and the like with pressure maximums of 8,000 psi or less being employed in many situations.

The device 10 may also include suitable measuring and analysis devices to determine and/or identify deviations in the rim 44 of wheel assembly 26 in the x, y or z axes that can affect conditions including, but not limited to, radial run out and lateral run out.

A suitable measurement device will be one that can be manually and/or automatically operable to ascertain one or more deviations from normal wheel configuration. The measurement device can be one capable of performing at least one measurement, marking, or detection function. It is contemplated that the marking and measurement device can be any suitable visual, auditory, or tactile device capable of ascertaining any dents or deviations from circular or true. Nonlimiting examples of such measuring devices can include, lasers, sensory feedback devices, as well as profilometers and the like. In the initial stages of wheel repair operations, the spindle assembly 18 and associated wheel assembly can be positioned with the dress face of the wheel assembly oriented toward a suitable measuring and marking device. In the embodiment depicted in the figures, this is an upwardly facing orientation. The spindle assembly 12 can rotate freely relative to the base. Rotation permits suitable measurement and marking to ascertain any dents or deviations from circular present in the wheel assembly.

Once trauma such as dents and deviations on a first face such as outer or dress face 24 have been ascertained, it is contemplated that a similar procedure can be performed on a second face such as the lower or non-dress face 34 as desired or required. To accomplish this, the wheel assembly 26 and spindle assembly 18 can be rotated 180° so that the inner or nondress face is oriented toward the measuring device. Alternately, it is considered within the purview of this disclosure that multiple measuring devices can be utilized to provide accurate marking and measurement on both faces without movement or rotation of the spindle assembly 18. These devices can provide either visual indication such as visible indicia on the wheel assembly at the dent or abnormality as desired or required.

It is also contemplated that data regarding the dents and deviations can be collected and electronically transmitted to a suitable data storage and processing unit as desired or required. Thus, accurate measurements of the existing damages on the wheel assembly can be processed against optimum wheel tolerances to formulate a repair solution in an electronically enabled embodiment of this invention. Such optimum values could be present in a suitable data library. It is also contemplated that a more simplified repair solution can be formulated by calculating deviations from circular without reference to a suitable data library.

The spindle assembly 18 has at least one suitable anchor plate 62 fixably positioned on the spindle assembly 18 relative to inner face 34 or outer face 24. The anchor plate 62 has a suitable shoulder 64 extending radially outward from the spindle assembly 18 as well as central region 66 capable of providing bracing support for at least one actuator device 50.

Figure 5A:
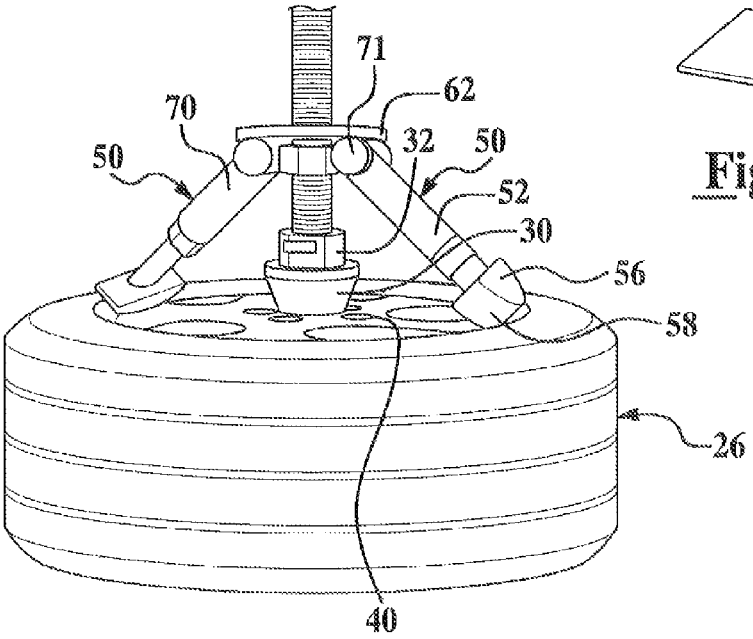
FIG. 5A is a detail of the wheel straightening apparatus with a plurality of actuators positioned in operative positions on the dress face of a wheel assembly unit.
Figure 5B:
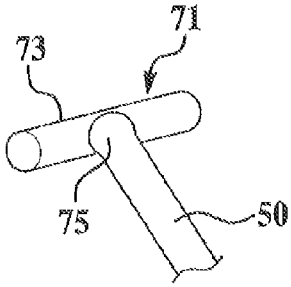
FIG. 5B is a detail of the rocker element of FIG. 5A.
Figure 8:
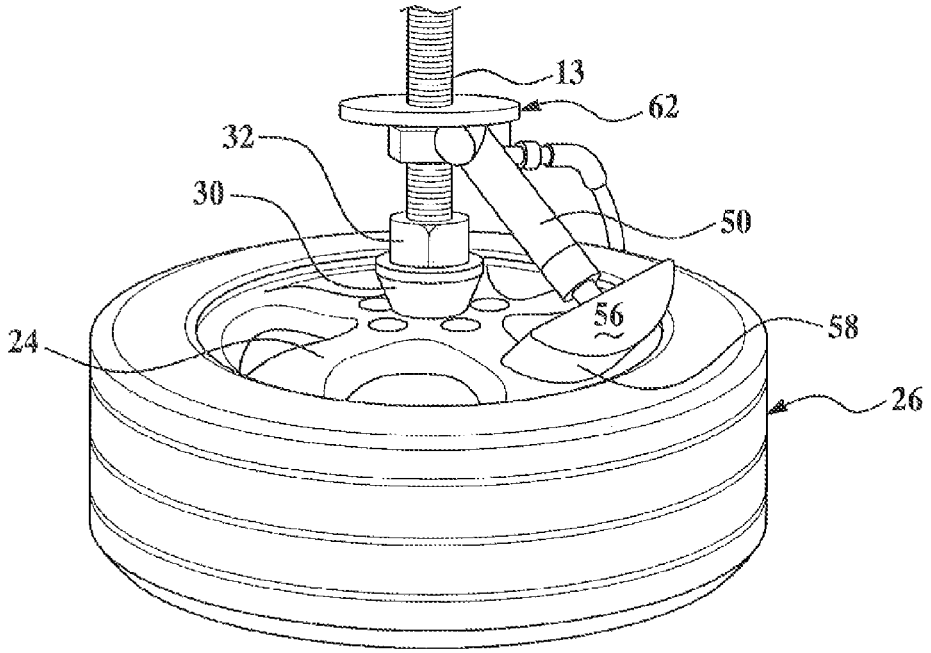
FIG. 8 is a view of the wheel straightening apparatus with an actuator in an operative position between the spindle and the wheel rim.

Actuator devices 70 such as hydraulic rams 52, 54 and jackscrew 70 are shown in various positions in FIGS. 5, 6, and 8 positioned to address the wheel rim 44 at location proximate to or overlying the bend, dent, or trauma. A jackscrew 70 is positioned in opposing relationship to the hydraulic rams 52, 54. It is contemplated that the jackscrew 70 can be positioned and configured to provide an opposing force to that exerted on spindle shaft 13 by hydraulic rams 52, 54.

The actuator devices 50 can be configured with suitable devices to anchor each anchor device into engagement with the shoulder 64. These anchoring devices can include suitable bolts, clips, or simple mechanical pressure and the like. One suitable anchoring configuration is depicted in FIG. 5A in which a rocker 71 is positioned in abutting relationship with the shoulder 64 of member 62 and a flat face of anchor nut 63. It is contemplated that anchor nut 63 has sufficient rotational movement relative to the platen 20 and wheel assembly 26 to be sufficiently adjustable to present a flat face on which the rocker 71 can abut.

Rocker 71 can be configured as a cylindrical or half-cylindrical body 73 having at least one central bore 75 into which the end of actuator 50 opposed to lead 56 can project. The rocker 71 can be releasably or permanently attached to actuator 50. The cylindrical outer surface of rocker 71 permits sufficient rotation of actuator 50 relative to the spindle 13 to facilitate angular adjustment of the actuator 50 and associated head 56 relative to wheel assembly 26. Actuators 50, such as hydraulic rams 52, 54 can be positioned at locations previously identified as dents, abnormalities, or the like during the measurement or data acquisition stage. Once in position, suitable hydraulic pressure can be exerted to remove or minimize the dent or abnormality.

Exerted pressure can be monitored by suitable sensors and the like (not shown). These sensors can be associated with or positioned on the actuator cylinders, in the heads 56, or within the hydraulic unit to which the actuator is attached to monitor the amount of pressure exerted. It is contemplated that the amount and manner of exertion can be varied based upon factors such as but not limited to the geometry or nature of the dent or abnormality. The amount of exerted pressure exerted can be manually calibrated. Alternately, it is also contemplated that the amount and type of exerted pressure can be modulated based upon repair solutions derived from the initial analysis of any abnormalities.

As seen in FIG. 5A, hydraulic actuators 52 are positioned to correct dents and trauma in the outer rim or lip 45 with variation in the angular orientation adjusted through rocker 71 as determined by specifics of the dent or trauma including but not limited to location, geometry, and severity. Hydraulic force is exerted against the central spindle shaft 13 through the shoulder 64 to address and urge the irregularity back into true. Where desired or required, this force against the spindle 13 is countered by a resistance force on the spindle 13 exerted by jackscrew 70. The force exerted by jackscrew 70 is typically sufficient to address and mitigate any bending force exerted on the spindle 13 and/or transfer or translate forces to the wheel assembly.

Where desired or required, the device can include a suitable perpendicular hydraulic ram 104 positioned between 102 and wheel assembly 26 (shown in phantom in FIG. 1) to project perpendicular force instead of or in addition to hydraulic rams such as ram 52. Where a hydraulic ram 104 is employed, it is contemplated that force exerted by the perpendicular hydraulic ram 104 can be countered by positioning a device such as a jackscrew 106 in opposed relationship to wheel assembly 26 to isolate the bend, dent or the like.

Once straightening operations on the outer or dress face 24 of the rim have been accomplished, the wheel assembly 26 can be rotated to identify and correct any abnormalities identified on the inner non-dress face 34. It is also contemplated that the order of wheel straightening operations can be reversed or can progress simultaneously as desired or required.

It is contemplated that the actuators can be positioned in any suitable configuration to address and correct the bend, dent, or irregularity present in a given wheel assembly. FIG. 6 depicts one nonlimiting example of a wheel straightening configuration for the inner non-dress face of a wheel assembly such as an alloy wheel. As discussed previously in connection with FIG. 5A, hydraulic ram(s) 52 can be positioned in angular orientation to the wheel assembly 26 to correct and address dents or abnormalities in the regions such as rim 44. In correcting dents and irregularities on the inner or nondress face, actuators such as hydraulic ram 54 can be positioned on the interior of the wheel assembly to correct significant deviations located on the interior surface. As with the previously mentioned actuator devices, the inner hydraulic ram 54 exerts pressure against the spindle shaft 13 rather than an opposed side of the wheel or of any other component such as a frame since.

It is contemplated that the spindle assembly 12 with an associated wheel assembly is freely rotatable about the base rotation mechanism and a central axis. The wheel assembly 12 and spindle rotation can be facilitated by suitable bearings 68 and associated assembly accessories including but not limited to guide cup 67 and spacer 69 associated with either the spindle apparatus 12 or base 19. It is contemplated that rotation of the assembly about axis can occur by suitable means. As depicted, rotation is accomplished by manual implementation.

The device 10 disclosed herein provides various advantages and attributes. As indicated previously, removal of tire 47 of wheel assembly 22 is not required to mount the wheel assembly 18 onto the spindle apparatus 12 of device 10. Similarly, the repair operation can be accomplished in many, if not most, instances without breaking the tire bead. However, it is also contemplated that repair operations can be accomplished on wheels without tires. Thus, in its very broadest sense "tire assembly" as the term is used herein is taken to mean a wheel with or without an associated tire.

It can be appreciated that the device 10 permits the wheel assembly to be secured rigidly on the spindle apparatus 12 in a manner very similar to the way the wheel mounts on a car, i.e. with a plurality of bolts, each being able to be torqued separately. This provides a true centerline about which the wheel is located and rotated where desired or required, the platen 20 can have a suitable frustoconical configuration that allows for the mounting of a wide variety of wheel styles. Similarly the positioning member can be configured to permit use with various wheel styles In the device disclosed herein, the wheel assembly mounted on spindle apparatus 12 can be inverted end-to-end without compromising the accuracy of the initial set-up. Thus, repair operations can be accomplished with relative ease for both the inside and the outside of the wheel assembly 18 with the mounting surface remaining rigid in either position. This configuration also provides for precise measurement in either orientation and provides for spinning, straightening, and measuring operations to be completed in a single set-up. As indicated previously, both manual and motorized operations can be accomplished in a single set-up.

The device 10 can spin on precise bearings 68 in a manner that permits the wheel to be mounted around its true center. Thus the wheel turns accurately and spins in the same plane as it does when it is mounted to a car. Thus precise measurements of any critical surfaces can be made with a statically mounted dial indicator or any other suitable measuring device as desired or required.

Additionally, the straightening operations themselves can be done by exerting straightening force. The orientation of the wheel assembly 18 to the shoulder 64 of anchor plate 62 provides an infinitely variable angle of adjustment for actuators relative to the wheel providing extensive straightening positions. Since the straightening pressure originates from a rigid surface independent of the wheel assembly 18, the opportunity for over straightening or damaging other locations on the wheel is greatly eliminated. Additionally, because the straightening pressure originates from a rigid surface independent of the wheel assembly, the straightening pressure can be applied very precisely. For example, it is possible to provide straightening only to the damaged area of the wheel rather than unaffected areas proximate or more distant from the damaged area. It is also possible to isolate the damaged area from interaction with other regions of the wheel assembly. As indicated previously, straightening can be done on either the inboard or the outboard side of the wheel as desired or required.

Figure 11A:
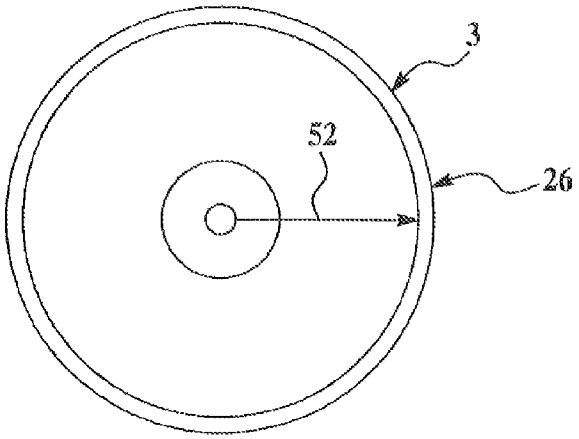
FIGS. 11A and 11B are schematic depictions of one straightening strategy as disclosed herein.
Figure 11B:
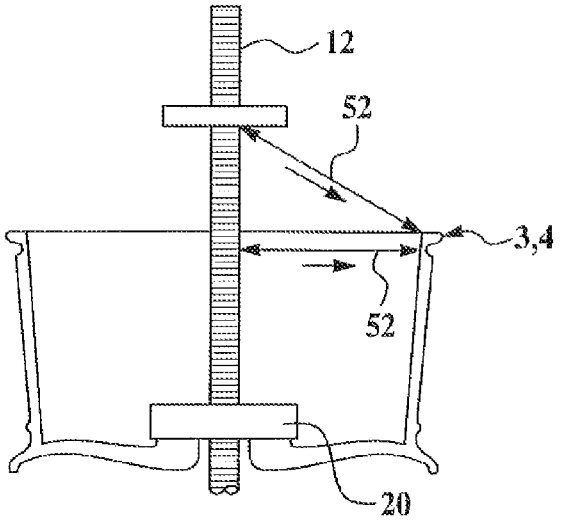

It is also contemplated that the device 10 can also apply resistance pressure in the opposite direction of the straightening pressure by application of actuators such as pneumatic or hydraulic rams 52, 54 and/or hand adjustable jackscrews 70 against the spindle shaft 13 and the rim of the wheel assembly 26. These can be appropriately positioned, then tightened such as hydraulically and/or manually against the opposing side of the bend. FIGS. 11A and B depicts one non-limiting example of multiple axis pressure applications that can be employed to repair a single bend in a wheel assembly. In this instance, a four-axis setup is shown with applications all involving pushing motions. In this arrangement, the wheel assembly 26 is securely captured in a manner that permits movement only in the area of the bend. In this type of setup the rams and/or jackscrews can be precisely positioned and focused with all pushing motions advanced simultaneously around the site of a single bend.

Where desired or required, it is contemplated that threads 72 on the central spindle shaft 13 (or mainshaft) can be used to apply downward and outward pressure simultaneously. As the wheel assembly 26 is held still, manual jackscrews 70, 70' can be set against the bend at a suitable angle from the mounting surface of the wheel assembly 18 at a suitable angle. One non-limiting example of such an angle is 30 degrees, as shown in FIG. 11B. Once in position, a nut assembly positioned on the spindle shaft 13 can be threaded downward. The downward movement of the nut assembly, which can be integrated with a suitable thrust bearing (not shown) contained on platen 20 allowing the nut and platen 20 to turn without disturbing the setup position of the manual jackscrews. As the nut assembly is turned downward, the manual jackscrews 70, 70' began applying pressure against the bend. At the same time the angle of the jackscrews decreases in multiples. Since a wheel becomes bent at angles multiple to the mounting surface, this motion of straightening is done in exactly opposite of the way the wheel was bent in the first place.

Figure 12:
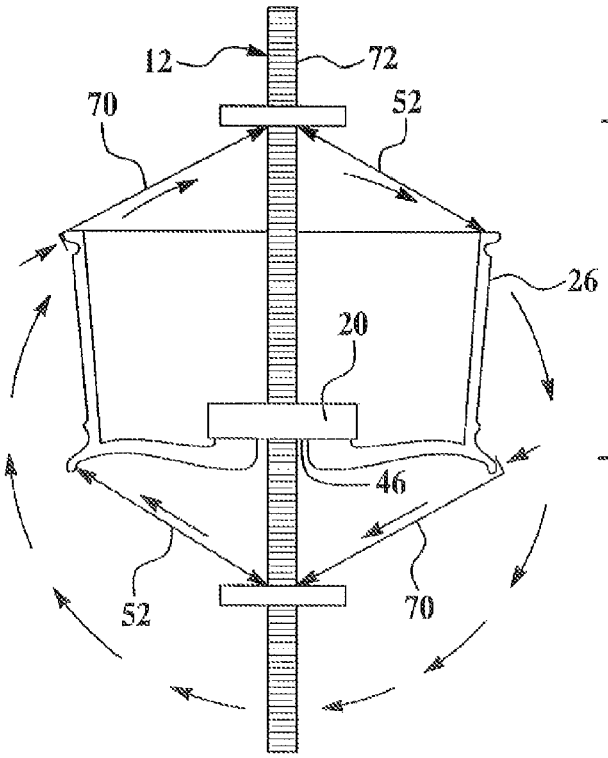
FIG. 12 is a schematic depiction of an alternate straightening strategy as disclosed herein.

It is contemplated that the device can be used to supply four-axis pressure applications positioned in a circular plane parallel with centerline of the central spindle shaft 13 as in FIG. 12. This application can be used to employ both push and pull pressure methods to the wheel assembly 26. FIG. 12 depicts one situation in which the device can be used to employ the use of both push and pull pressure methods in order to straighten wheels that are bent, particularly through the hub 46 of the wheel, which is within the circle shown (clockwise pointing arrows). In the event a wheel is bent this way, the intersecting centerlines of the wheel, are no longer 90 degrees apart. The amount of the bend can be determined through indicator measurements, however the exact location of the bend may not be apparent. Even so, there is a strong likelihood that the weakest point within the circle shown is also the location where the metal is bent. A set-up such as that depicted in FIG. 12, can be employed to create enough torque to re-bend the metal; bringing the wheel back into its proper plane.

Figure 7:
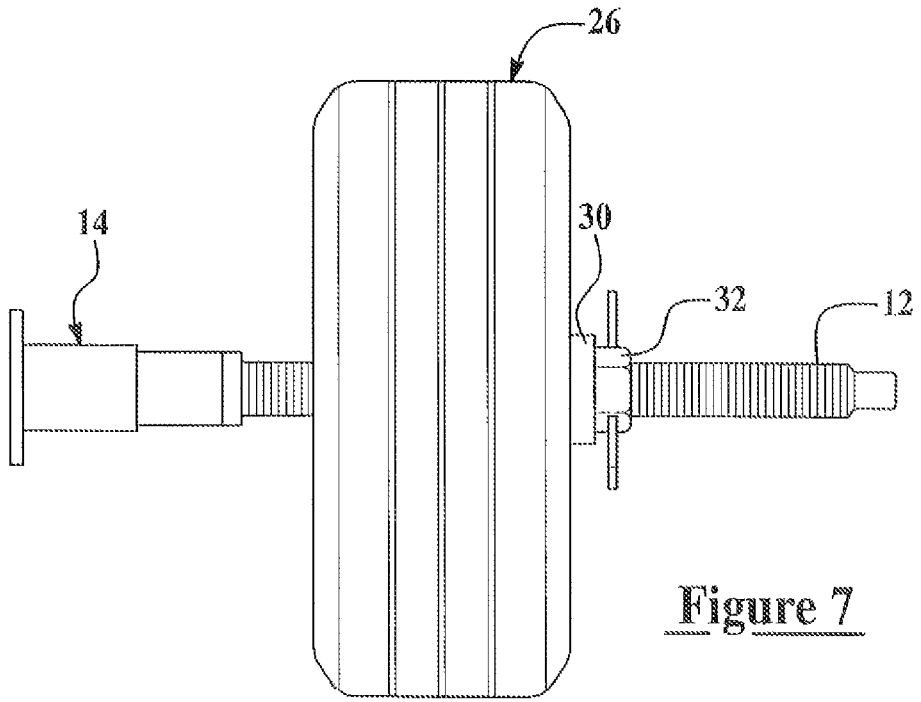
FIG. 7 is a view of the spindle assembly with a wheel assembly unit attached thereto.

FIG. 12 depicts a push application on one edge of the wheel being as by ram 52 assisted by a pull application set up as by jackscrew 70 in the same plane on the other edge 180 degrees away. This setup begins a circular (in this view clockwise) motion in that the circular motion is both intensified and reinforced. While the resulting strain on the metal from this circular motion is distributed and supported on the outer edges, the torque is also transferred to the weakest point within the circle. This motion allows the operator to force the axis centerlines to flex and rotate past 90 degrees in incremental amounts. The torque will find the bend and this very difficult repair can be accomplished.

Where desired or required, it is contemplated that spindle apparatus 12 and associated device 10 can be used securely either with the spindle shaft 13 in a vertical plane (normal configuration), such as the setup shown in FIGS. 11A and B or in a fully horizontal plane, such as might be the case of the setup shown in FIGS. 7 and 12. It is also contemplated that the device can be tipped out of the vertical plane and supported in an angled position, which could be more suitable for a specific task. This feature is particularly useful for laying a bead of weld on a wheel, as well as other direct or ancillary tire straightening operations.

As indicated previously, the device can be used to spin the wheel manually, automatically, or with a combination of both. A variable speed version of the motorized machine is contemplated to spin the wheel in either direction and at an appropriate revolution rate. By way of nonlimiting example, all speeds up to 500 rpm are contemplated. Where desired or required, the device can be employed to facilitate tire bead breaking with both manual and hydraulic bead breaking operations being contemplated.

The device can be advantageously employed in an environment where storage and working space is of vital importance. One nonlimiting example of such an environment is in mobile applications as in trucks, vans, and the line. Thus, the device as conceived has a base that consumes only about 1 square foot of floor space and a frame that consumes as little as 4 square feet of floor space.

It is contemplated that the device 10 can be employed in various locations. One non-limiting example of such a location is in conjunction with a mobile device such as a van, truck, trailer, or the like. In such instances it is contemplated that the base or and/or frame will be mounted to the mobile device in a manner that facilitates use. The mobile device can include suitable accessories including but not limited to hydraulic or pneumatic pumps to operate rams as well as measurement and diagnostic equipment. In this manner, the mobile device with the wheel straightening device 10 associated therewith can be brought to the location of the vehicle with the wheel to be repaired.

While it is contemplated that the device can be employed without breaking the tire bead, in certain instances bead breaking may be required. The device in can be employed to provide rotation that eases the bead breaking operation. It is contemplated that both manual and hydraulic bead breaking methods can be used successfully with the device disclosed herein.

It can be appreciated that the wheel is securely mounted to a rigid and precision platen. Thus, the control of tire movement is greatly increased. Additionally, the hydraulic straightening applications can be done by a variety of controllable angles that can be deduced and calculated against the rigid spindle and associated device. It can be seen that the device can be used to capture, measure, straighten, and spin in a single rigid and accurate set-up.

It is also contemplated that the device disclosed herein can be employed such that two or more hydraulic rams are mounted in different positions around the central spindle shaft. The axis of these rams can be staggered at various angles, while all pressure originates from a central point perpendicular to the damaged area of the wheel thereby using a straightening pressure application to a wheel from a central axis point independent of the wheel. This should include the possibility that the procedure could be done while the wheel is still on the car. On some minor bends on the inboard side of the wheel, other parts of the motor vehicle near the wheel could be used to support the stationary end of the ram while applying hydraulic pressure to the damaged area of the wheel.

It is contemplated that the device as disclosed herein can accomplish and permit wheel straightening operations with the spindle in a variety of orientations including vertical, horizontal and other angular orientation from vertical or horizontal as would be appropriate given circumstances including but not limited to the location of the wheel to be straightened, the repair environment and the type of bend, dent or irregularity. It is also contemplated that the spindle apparatus with the wheel assembly affixed thereto and an actuator or actuators in place can be moved from one orientation to another without disturbing the set up or configuration of the actuator(s).

Figure 13:
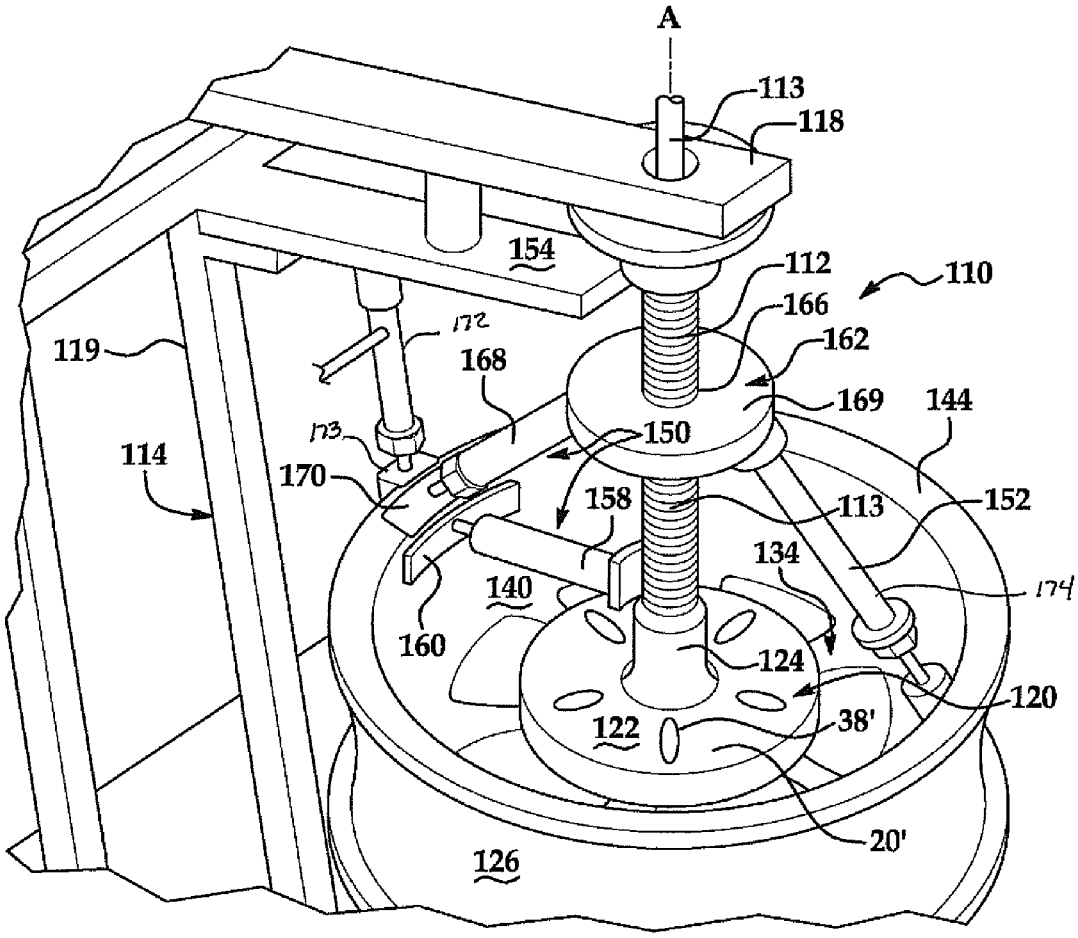
FIG. 13 is a perspective view of an alternate embodiment of the wheel straightening apparatus as disclosed herein

An additional embodiment of the device disclosed herein is depicted in FIG. 13. This embodiment and the method that is associated with this embodiment are predicated on the unexpected discovery that subjecting a dent or irregularity and the region located thereto to a sequential of increasing and decreasing dynamic force can address stubborn dents and irregularities that are not effectively treatable by the device and method previously desired. The embodiment is directed to a configuration for exerting dynamic forces on the dents or imperfections in the associated rim.

The embodiment depicted in FIG. 13 is directed to a device 110 composed of a spindle apparatus 112. The spindle apparatus 112 is configured to be releasably connected to a suitable mounting mechanism to facilitate operation on the associated wheel rim 126. In the embodiment depicted in FIG. 13, spindle apparatus 112 with associated wheel rim 126 mounted thereon is positioned in an orientation perpendicular to the associated floor or other support surface. However, it is contemplated that the orientation of the spindle 112 can be any orientation relative to horizontal that is capable of permitting rim straightening operations.

It is also contemplated that the spindle 112 can be detached from connection with any suitable mounting device with suitable actuators in place and the fixtured spindle can stored moved or operated on as desired or required. In the embodiment as depicted in FIG. 13, the spindle 112 is releasably connected to mechanism 114 for perpendicular attachment to a lower support surface such as a frame, floor, or bed of a suitable truck or other mobile device. Where desired or required, it is contemplated that the mechanism 114 can be permanently mounted in a suitable stationary location.

The spindle 112 may be mounted to the mechanism 114 in a manner such that the spindle can be fixed from rotation if desired or required. It is contemplated that that mechanism may include suitable bearings and devices for facilitating rotational movement of the spindle apparatus 112 around an axis A extending longitudinally through the spindle 112 if desired or required. It is also contemplated that the mechanism can include suitable breaks or stops to limit or prevent rotational movement when needed. It is also contemplated that rotational movement can be facilitated by suitable devices connected to the spindle in either permanent or detachable manner.

In the embodiment FIG. 13, the spindle 112 is configured to position the mounted wheel rim at a spaced distance from the floor or a suitable lower support surface in the manner outlined in FIG. 1. It is also contemplated that the spindle 112 can be configured such that one face of the wheel rim 126 is proximate to or in contact with at least one pressure exerting member configured to exert upward pressure on the wheel rim 126 in at least one location on the wheel rim 126. The location can be at single isolated points or can be a more global upward pressure depending upon a variety of factors including but not limited to the dent to be corrected. It is contemplated that, in certain applications, the pressure exerting member can be a jackscrew or the like and can be moveably located to correspond to a suitable location on the wheel rim 126.

In the embodiment as depicted in FIG. 13, the spindle apparatus 112 also has an opposed end adapted to be rotationally mounted relative to a suitable bracket arm 118, if desired. In the embodiment depicted in FIG. 13, the bracket 118 extend perpendicularly out ward in cantilevered relationship to an upwardly extending support 119 of frame 114.

It is contemplated that the spindle apparatus 112 can be mounted in any suitable fashion to permit rotation during appropriate phases of the wheel assembly straightening operations. Therefore, it is contemplated that the frame 114 may be modified or eliminated in certain embodiments as desired or required. In the embodiment depicted in FIG. 13, the bracket 118 has a suitable aperture extending there through to moveably receive the upper end 119 of spindle 112.

It is contemplated that the spindle apparatus 112 can be configured to accommodate wheels of different diameters with wheel rim diameters up to or including 36 inches being contemplated as is generally encountered in various automotive passenger vehicles. It is also within the purview of this disclosure to employ the spindle apparatus 112 disclosed herein for wheel straightening operations on wheels employed on automotive vehicles such as light duty and heavy duty trucks as well as off road vehicles and a variety of non-automotive applications. Without being bound to any theory, it is believed that the wheels of the latter classes of vehicles were generally more problematic to treat according to the method previously disclosed.

It is contemplated that the wheel straightening apparatus can be used on various wheel rim assemblies 126 used on various vehicles. The wheel rim assemblies 126 can be composed of any suitable material of which alloy wheels are one configuration. Wheel rim assemblies 126 can generally include elements such as rim 144, central hub 146, with central shaft 128 defined therein, and central body portion 148.

The spindle apparatus 112 includes means 120 for positioning the wheel rim 126 in operable position relative thereto. The term operable position as used herein is taken to mean a position in which wheel rim straightening processes such as those outlined herein can take place. In the embodiment depicted in FIG. 13, the wheel rim positioning means is a platen. Suitable platens include but are not limited to platen 20 describe previously in conjunction with FIG. 1. In the embodiment depicted in FIG. 13, the platen 20' includes a generally planar body 122 contiguously joined to a central sleeve 124. Where desired to required the interior of the central sleeve 124 can be configured with suitable threads that can matingly engage the threaded surface of spindle 112. It is contemplated that platen 20' can be at an appropriate location on the length of spindle 112 and has a wheel contacting face (not shown) and an opposed outwardly oriented face 124.

The wheel rim positioning means also includes a suitable anchoring device configured to position the wheel rim firmly against the platen 20'. Non-limiting examples of suitable wheel rim anchoring devices include the positioning device 22, shown as a frustoconical member in FIGS. 2, 4, 5, 6, and 7. The positioning device 22 can be placed in clamped abutting engagement against the outer or dress face 24 of the wheel rim 126 when the wheel rim 126 is positioned in operable orientation on the spindle apparatus 112. The anchoring device and associated platen can be held by a series of clamps as desired or required with the spindle apparatus 112 extending through the central hub shaft (not shown) of the wheel rim 126. The wheel assembly positioning means can be configured to engage the hub shaft of various configurations of wheel rim 126 in secure positioned manner.

The platen 20' is positioned on the spindle apparatus 112 at a suitable position such as a position proximate to the midpoint of the spindle 112. It is contemplated that the platen 20 can be permanently or moveably attached to the spindle as desired or required. When the spindle 112 is in the use configuration, the platen 20' can be positioned such that it is in abutting relationship with the inner or non-dress face 134 of the wheel assembly 126.

The platen 20' can have a suitable configuration including, but not limited to, the configuration depicted in connection with the embodiment discussed in FIG. 1. It is contemplated that the assembly disclosed in this embodiment can be used to straighten wheel assemblies 126 with or without the tire and tire bead intact.

The spindle 112 also has at least one suitable anchor plate 162 fixably positioned on the spindle 112 relative to inner face 34 and/or outer face 24. The anchor plate 162 has a suitable shoulder 169 extending radially outward from the spindle assembly 18 as well as central region 166 capable of providing bracing support for at least one of a plurality of separately activated actuator devices 150. It is also within the purview of this disclosure that the anchor plate can be configured to provide bracing support for a least one stabilizing device. Where desired or required, the spindle can include at least two anchor plates disposed on the spindle on opposite sides of the wheel rim assembly 126. It is also within the purview of this disclosure to include two or more anchor plated of differing diameter on a single side of the spindle 112 to provide a variety of angular bracing options.

The anchor plates 162 can be configured to be removably positioned relative to the spindle 112 to accommodate placement of the wheel rim assembly 126 on the spindle 112. It is also contemplated that, where desired or required, at least one of the anchor plates can be moveable relative to the spindle 112 in the use position in order to achieve suitable bracing force. Where the anchor plate 162 to moveable, it is contemplated that the anchor plate will be configured with suitable clamps or other anchoring device such that, when proper pressure is exerted, the anchor plate can be placed in fixed position relative to the spindle 112.

The device 110 also includes a plurality of separably activated dynamic actuator devices 150 configured to be removably positioned in contact with the wheel rim assembly 126 and various orientations relative there to. Where desired or required the separately activated dynamic actuator devices can be governed by a suitable control device (not shown).

The dynamic actuator devices 150 can be any suitable device or apparatus capable of exerting an outward force or pressure on the desired region of the rim 144. Dynamic actuator devices 150 may include, but are not limited to, pneumatic or hydraulic rams operably positioned at a target location on or proximate to the dent or irregularity to be operated upon. It is contemplated that the device depicted in the embodiment in FIG. 13 will include at least three dynamic actuator devices 150 configured to exert intermittent force on the target region on the wheel assembly 126 of interest. The intermittent force exerted may be in any suitable pattern or sequence capable of accomplishing a messaging force on the dent or irregularity and the region immediately proximate thereto.

In the embodiment depicted in FIG. 13, the three dynamic actuator devices are each configured as pneumatic or hydraulic rams. The pneumatic or hydraulic rams can be configured with pressure heads configured to transmit the desired force over the desired area in the location of the bend or dent. Suitable pressure heads can have a variety of contact surface of which the convex and flat contact surfaces are two examples. In the configuration depicted in FIG. 13, the assembly has at least one dynamic actuator device 158 having a convex pressure head 160. As depicted actuator device 158 is positioned between the spindle 112 and the inner surface of wheel rim assembly 126. Positioned proximate to actuator device 158 is a dynamic actuator device 168 having a flat pressure head 170. Dynamic actuator device 168 is positioned between the anchor 164 and the curved surface of wheel rim assembly 126. The third dynamic actuator device 172 is configured with flat pressure head 173 and is positioned between the outwardly facing surface of wheel rim 126 and the support beam 154. Each dynamic actuator device can be equipped with a suitable pneumatic or hydraulic line (shown as cut away for clarity) to pressurize and/or depressurize the associated device as desired or required. The dynamic actuator devices can be coupled to a suitable controller to vary pressurization and depressurization of the respective devices in a pattern and/or sequence to achieve messaging force.

The device 110 such as that disclosed in the embodiment in FIG. 13 can also include at least one pressure exerting stabilizing device 152 such as jack screw 174 located in opposed relationship to the dynamic actuator devices 150. The pressure exerting stabilizing device 152 such as jack screw 174 can be positioned in any suitable orientation that will counterbalance and/or direct forces exerted in the wheel rim 126 by the dynamic actuator devices 150. In FIG. 13, jack screw 174 is positioned between the rim 144 and spindle 112 at an angle other than 90 degrees as measured between the spindle 112 and the jack screw 174.

It is also contemplated that the device 110 can also apply resistance pressure in the opposite direction of the straightening pressure by application of actuators such as pneumatic or hydraulic rams 150 and/or adjustable jackscrews 174 against the spindle shaft 113 of spindle device 112 and the rim of the wheel assembly 126. These can be appropriately positioned, then set against the opposing side of the bend.

It is also considered to be within the purview of this disclosure to utilize a pressure exerting stabilizing device 152 such as a jack screw 174 deployed between the wheel rim 126 and a fixed surface other than the spindle 112, for example it is contemplated that a suitable jack screw (not shown) can be positioned between the floor or other support surface and the wheel rim 126 at a location such as that outlined in FIG. 1 or at a location that is generally located radially and laterally opposed to the dynamic actuator devices 150.

Where desired or required, it is contemplated that the device 110 can also include suitable frame elements against which at least one of the dynamic actuator devices 150 and/or the stabilizing device 152 can be can be braced. Suitable elements of frame 114 include, but are not limited to, support beam 154. In the embodiment depicted in FIG. 13, support beam 154 is connected upwardly projecting support member 119 and extends outward in cantilevered relationship therefrom.

Where desired or required, the support beam 154 is mounted to the upwardly projecting member 119 of frame 114 at a location that disposes it between the bracket 118 and the platen 20' when the device is in the operative position. It is contemplated that the support beam 154 can be braced against bracket 118 by any suitable means such as a bracing jackscrew or pillar 156.

The device 110 can also include a suitable controller for coordinating or signaling the pressurization and/or depressurization of the associated actuation device 150 in a manner that messages the dent and/or the surrounding region. Without being bound to any theory, it is believed that the multiple axis straightening process achieved by the device as embodied in FIG. 13 permits a more effective straightening operation that can result in a stronger and/or more effective resolution to some types of deformed region of the associated wheel rim even over that contemplated in the dual axis straightening method set forth else where in this disclosure.

It is believed that the additional axes of pressure and/or support provide a more focused straightening opportunity permitting force concentration on a specific portion of a bend. Since these axes are independent, the pressing and supporting forces can be applied more gradually and can be distributed over a wider area in damage location. For example, while supporting pressure is being applied to the outside edge of a wheel, "massaging" forces can be simultaneously applied to the inside surfaces. This "sharing" of forces is less stressful on the metal during the straightening process and the chances of a success are greatly increased.

In the messaging method disclosed herein, it is contemplated that three or more dynamic actuator devices are pressurized to deliver a localized pressure of a suitable level to the region to be addressed. Nonlimiting pressure levels include 8000 to 10000 psi initial.

Once the pressure reaches 8000 psi initial, the force exerted by one or more of the dynamic actuator devices can be backed off incrementally to a suitable lower level, typically greater than 1000 to 2000 psi but less than initial pressure. This will result in an elevation in realized pressure exerted by the remaining dynamic actuation devices on the wheel rim location. Cycling of the various dynamic actuation devices through upward and downward pressure cycles can be used in an appropriate sequence to gradually reduce deformations from true in the wheel rim body. The duration of each cycle can be an interval sufficient to achieve messaging action. In certain instances, this can range from approximately ¼ sec. to 5 minutes.

It is to be understood that when a metal is bent, deformation occurs down as far as the molecular level. Straightening efforts heretofore have been directed at rebending the metal, in other words redamaging the metal. It has been found quite unexpectedly that the messaging action achieved by a device utilizing at least three separately operable dynamic actuation devices directed at a dent or region to be corrected can sequentially transfer at least a portion of the redamaging force in a way that preserves at least a portion of the structural integrity of the metal.

While the invention has been described in connection with what is presently considered to be the most practical and preferred embodiments, it is understood that the invention is not limited to the disclosed embodiments, but is intended to cover various modifications and equivalent arrangements included within the spirit and scope of the claims. The claims are to be accorded the broadest possible interpretation so as to encompass all such modifications and equivalent structures and instructions as permitted under the law.

What is claimed is:

1. A wheel straightening apparatus comprising:

a rotatable spindle having a first end and a second end, wherein the rotatable spindle has a threaded outer surface;

a platen mounted on the spindle at a point intermediate to the first and second ends, the platen configured to engage a wheel assembly in a fixed position relative to the spindle, the wheel assembly comprising a rim and a central portion, the central portion having a dress face and an inbound face and defining a central hub shaft located concentric to the wheel assembly, wherein the rotatable spindle is concentrically positionable relative to the platen and the associated central hub shaft of the wheel assembly, and wherein the threaded outer surface of the of the rotatable spindle extends from the first end to the second end of the rotatable spindle;

at least two dynamic actuator devices positioned and configured to exert pressure on a section of the rim of the wheel assembly to be straightened, the actuator devices configured to exert a straightening force on the rim, wherein the at least two actuator devices are positioned between the spindle and the rim, wherein the two actuator devices exert pressure on the rim independent of one another.

2. The wheel straightening apparatus of claim 1 further comprising an attachment mechanism, rotatably connected to the first end of the spindle, the attachment mechanism configured to be mounted on a support surface, the support surface including at least one of a frame, a floor or a bed located in a mobile device.

3. The wheel straightening device of claim 1 wherein the actuator devices are at least one of a hydraulic ram or pneumatic ram and wherein the actuator devices exert pressure on the wheel rim independent of one another, the wheel straightening device further comprising at least one jack screw.

4. The wheel straightening apparatus device of claim 1 wherein the platen comprises a central body having a center region threadingly connected to the spindle, an upper face and an opposed lower face; and at least one fastener engageable with either a slot or at least one lug nut opening configured in the wheel, the fastener configured to secure the wheel to the platen.

5. The wheel straightening device of claim 4 further comprising at least one pressure exerting stabilizer device in contact with the spindle and a location on the wheel rim.

6. The wheel straightening device of claim 1 further comprising at least one pressure exerting stabilizer device positioned between the spindle and the rim of the wheel assembly at a location opposed to the portion of the wheel to be straightened.

7. The wheel device of claim 1 wherein at least one of the two actuator devices is positioned on the dress face of the wheel assembly and at least one of the two actuator devices is positioned on the inbound face of the wheel assembly.

8. The wheel device of claim 1 further comprising:

at least one bracket, the bracket mounted to a support surface and releasably and rotatably engaging at least one end of the spindle;

at least one beam, mounted to the spindle and extending outward therefrom; and at least one additional actuator device, the additional actuator device extending between the beam and the rim of the wheel assembly.

9. The device of claim 1 wherein the spindle is unitary.

10. A device for straightening wheel assemblies comprising:

a work bed;

an apparatus attached to the work bed, the apparatus including:

a) a mounting device affixed to the work bed;

b) a spindle having a first end and a second end and an outer threaded surface extending from the first end to the second end, at least one end removably connected to the mounting device, the spindle rotatable along a central axis when the spindle is connected to the mounting device;

c) a platen mounted to the spindle, the platen configured to engage a wheel assembly in a fixed position coaxial to the spindle, the wheel assembly comprising a rim and a central portion wherein at least one of the rim and central portions have at least one irregularity, the central portion having a central hub shaft located concentric to the wheel assembly, wherein the rotatable spindle is concentrically is positionable relative to the platen and the associated central hub shaft of the wheel assembly; and d) at least two dynamic actuator devices positionable between the spindle and the rim of the wheel assembly, each dynamic actuator device having a first end and a second end, each dynamic actuator device configured to exert an independent straightening force on the rim;

e) a controller operably interacting with the dynamic actuator devices; and f) an anchor plate coaxially mounted on the spindle and extending outward therefrom to form a junction, wherein the first end of at least one of the dynamic actuators contacts the spindle at the junction defined by the spindle and the anchor plate.

11. The device of claim 10 wherein the least two actuator devices are each at least one of a hydraulic ram, or a pneumatic ram.

12. The device of claim 11 wherein the at least two actuator devices are adjustably positionable relative to the irregularity in the wheel assembly, wherein the dynamic actuator devices are capable of delivering straightening force independent of one another.

13. The device of claim 10 wherein at least one additional actuator device is positionable between the spindle and the rim of the wheel assembly at a location opposed to the portion of the wheel to be straightened.

14. The device of claim 10 wherein the mounting device includes at least one bracket, the bracket mounted to a support surface and releasably and rotatably engaging at least one end of the spindle and wherein the apparatus further comprises:

at least one beam, mounted to the spindle and extending outward therefrom; and at least one additional actuator device, the additional actuator device extending between the beam and the rim of the wheel assembly.

15. A method for straightening at least one irregularity in a wheel, the wheel comprising a rim, a central region, the central region defining a central hub shaft located concentric to the wheel assembly a plurality of lug nut holes disposed around the central hub shaft, the central region having a dress face and an inbound face, the method comprising the steps of:

positioning the wheel to be straightened on a device, the device including:

a) a rotatable spindle having a first end and an opposed second end, wherein the spindle has a threaded outer surface, extending from the first end to the opposed second end;

b) a platen mounted on the spindle at a point intermediate to the first and second ends, the platen configured to engage the wheel in a fixed position relative to the spindle, the platen having a plurality of slots;

c) at least two dynamic actuator devices positioned and configured to exert a variable straightening force on the rim of the wheel to be straightened, the at least two dynamic actuator devices positioned between the rim and that spindle;

attaching the platen to the central region of the wheel such that the wheel is located concentric relative to the spindle and the threaded region of the spindle extends through the central hub defined in the central region;

positioning the at least two actuator devices between the spindle and a location on the wheel associated with the irregularity on the wheel; and triggering a first of the at least two dynamic actuator devices to exert a straightening force on a location associated with the irregularity on the wheel;

after triggering the first of at least two dynamic actuator devices, triggering a second of two dynamic actuator devices to exert a straightening force on a location associated with the irregularity on the wheel wherein the first and second dynamic actuator devices each exert an independent coordinated straightening force.

16. The method of claim 15 wherein the fastening step comprises engaging a plurality of fasteners through lug nut holes in the wheel and slots in the platen, each fastener separately torqued into engagement.

17. The method of claim 16 further comprising the step of positioning at least one stabilizing device in engagement between the spindle and the wheel rim, the stabilizing device exerting a stabilizing force on the wheel rim.

18. The method of claim 17 wherein the forces exerted by the actuator devices on the location on the wheel rim vary over time in response to straightening action detected in the location on the wheel rim.

19. A mobile device for straightening wheel assemblies comprising:

a vehicle having a work bed;

an apparatus attached to the work bed of the vehicle, the apparatus composed of:

a) a mounting device affixed to the work bed;

b) a unitary cylindrical spindle having a first end and a second end, at least one end removably connected to the mounting device, the spindle rotatable along a central axis when the spindle is connected to the mounting device;

c) a platen mounted to the spindle, the platen configured to engage a wheel assembly in a fixed position coaxial to the spindle, the wheel assembly comprising a rim and a central portion wherein at least one of the rim and central portions have at least one irregularity;

d) an anchor plate coaxially mounted on the spindle and extending outward therefrom to form a junction; and e) at least one dynamic actuator device positionable between the spindle and the rim of the wheel assembly, the dynamic actuator device configured to exert an independent straightening force on the rim, wherein a first end of at least one of the dynamic actuator contacts the spindle at the junction defined by the spindle and the anchor plate.

* * * * *